US008807180B2

(12) United States Patent
O'Connor

(10) Patent No.: US 8,807,180 B2
(45) Date of Patent: Aug. 19, 2014

(54) DUAL FLUID FUELING NOZZLE

(75) Inventor: David O'Connor, North Bend, WA (US)

(73) Assignee: Asemblon, Inc., Woodinville, WA (US)

( * ) Notice: Subject to any disclaimer, the term of this patent is extended or adjusted under 35 U.S.C. 154(b) by 0 days.

(21) Appl. No.: 13/488,210

(22) Filed: Jun. 4, 2012

(65) Prior Publication Data

US 2012/0305134 A1 Dec. 6, 2012

Related U.S. Application Data

(60) Provisional application No. 61/492,714, filed on Jun. 2, 2011.

(51) Int. Cl.
*B65B 1/04* (2006.01)

(52) U.S. Cl.
USPC ..... 141/302; 141/65; 141/389

(58) Field of Classification Search
USPC ..... 141/59, 65, 285, 290, 348–350, 206, 141/302, 389
See application file for complete search history.

(56) References Cited

U.S. PATENT DOCUMENTS

2006/0272733 A1* 12/2006 Fink et al. ..... 141/59
2009/0025824 A1* 1/2009 Noujima et al. ..... 141/93

* cited by examiner

*Primary Examiner* — Jason K Niesz
(74) *Attorney, Agent, or Firm* — Olympic Patent Works PLLC

(57) ABSTRACT

The current application is directed to a single-spout, dual-channel recyclable-fuel fueling nozzle that extracts spent fuel from a vehicle and introduces fresh fuel into the vehicle via a single filler neck. Liquids move in two different directions within two separate channels of the dual-channel recyclable-fuel fueling nozzle to and from two different reservoirs within the vehicle, including a fresh-fuel reservoir and a spent-fuel reservoir.

17 Claims, 6 Drawing Sheets

DUAL FLUID FUELING NOZZLE

CROSS-REFERENCE TO RELATED APPLICATION

This application claims the benefit of Provisional Application No. 61/492,714, filed Jun. 2, 2011.

TECHNICAL FIELD

The current application is directed to fuel systems for fueling vehicles and, in particular, to a single-spout, dual-channel fueling nozzle that extracts spent fuel from a vehicle and introduces fresh fuel into the vehicle.

BACKGROUND

The fueling of a vehicle that uses recyclable fuels involves the input of fresh fuel, in certain cases hydrogenated fuel from which hydrogen can be extracted by internal vehicle components for powering the vehicle, while at the same time removing used or spent liquid fuel, in certain cases relatively dehydrogenated fuel. There have been proposed a number of different technologies that feature a nozzle with two different parallel spouts mounted side by side on a single handle. The use of this type of nozzle is quite cumbersome, since each of the two spouts mate to a different, separate filler neck. Fluid flows out of one spout into the filler neck of the fresh fuel tank in the vehicle. Fluid from the vehicle's used fuel tank is pumped out through the second filler neck. There are still other recyclable-fuel nozzles that mount to a bayonet-type filler neck. These nozzles are useable, but are not publically accepted because operation of this type of recyclable-fuel nozzle is not intuitive to the average user.

SUMMARY

One example of the fuel systems to which the current application is directed comprises a single-spout, dual-channel recyclable-fuel fueling nozzle that extracts spent fuel from a vehicle and introduces fresh fuel into the vehicle via a single filler neck. Liquids move in two different directions within two separate channels of the dual-channel recyclable-fuel fueling nozzle to and from two different reservoirs within the vehicle, including a fresh-fuel reservoir and a spent-fuel reservoir.

DETAILED DESCRIPTION

Description

The current application is directed to a single-spout, dual-channel recyclable-fuel fueling nozzle and complementary vehicle filler neck for transferring fuels to and from a vehicle. Fueling is accomplished such that, as a quantity of fuel is inserted into the on-board fresh-fuel tank, a like quantity is extracted from a second on-board spent-fuel tank.

Figure 1:
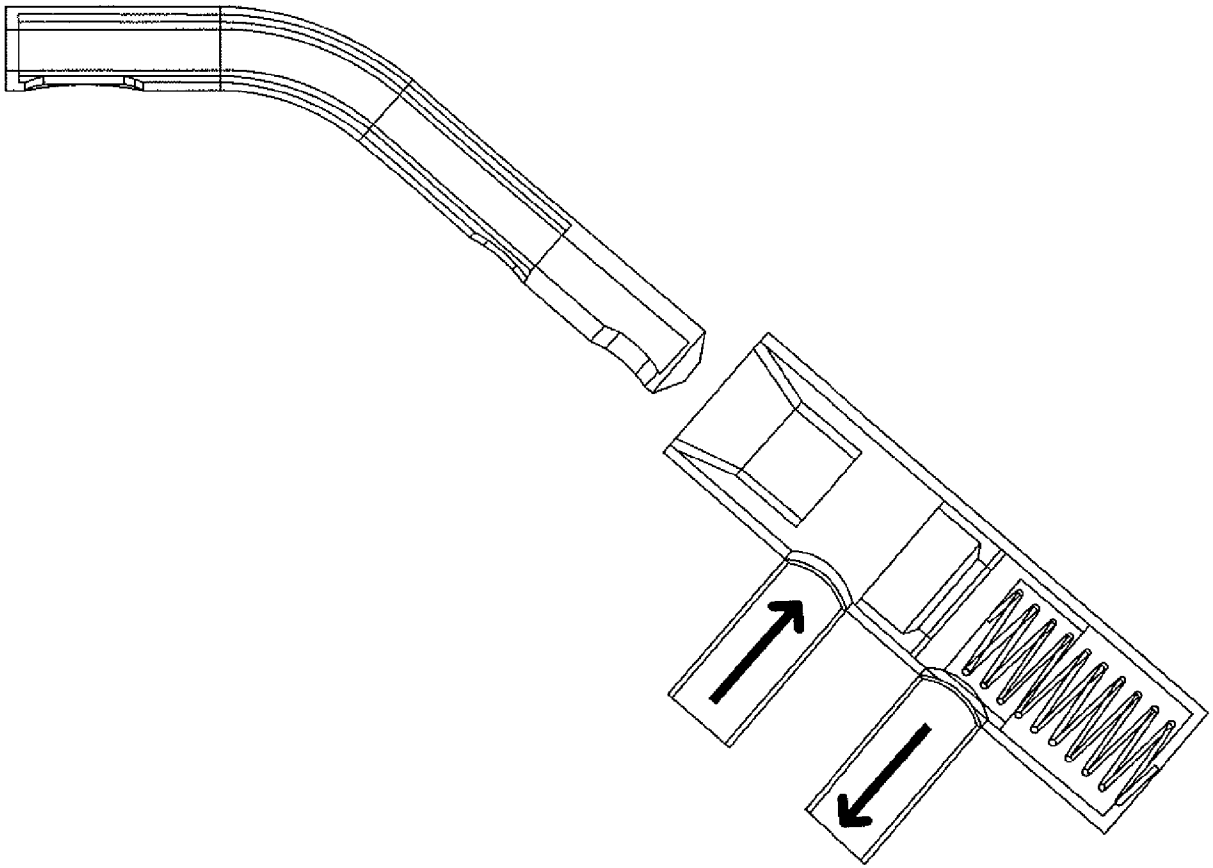
FIG. 1 illustrates a fueling nozzle and filler neck, not mated, of a single-spout, dual-channel recyclable-fuel fueling nozzle.

FIG. 1 illustrates a fueling nozzle and filler neck, not mated, of a single-spout, dual-channel recyclable-fuel fueling nozzle. The nozzle itself is coaxial in design, where fresh fuel flows through the center channel and out of the nozzle to the vehicle tank. The two fluids flow in opposite directions within the nozzle. Spent fuel flows into the outer channel of the nozzle from the spent-fuel tank within the vehicle. The volumes of the two channels are approximately equal even though the geometries may not be identical or even similar. This assures that the flow rate through the nozzle in both directions is uniform. The fluid flow is synchronized, such that if the difference between the quantity of the flow into the nozzle from the vehicle and the quantity of the flow out of the nozzle to the vehicle is not below a small threshold value, the system shuts off. This no-flow condition indicates the fuel tank in the vehicle is full and stops the filling process. This configuration of outer channel as the spent or used fuel allows for the sealing of the outer diameter of the nozzle to return any fuel that leaks to the bulk spent-fuel tank.

Operation

The filler cap of the filler neck is first removed. The figures have the filler cap removed to show clarity of the overall design. The filler nozzle is now inserted into the filler neck until is stops. This is similar to what we do today when filling a vehicle with gasoline. The nozzle trigger is squeezed and the filling begins.

Inserting of the Nozzle into Filler Neck

Figure 2:
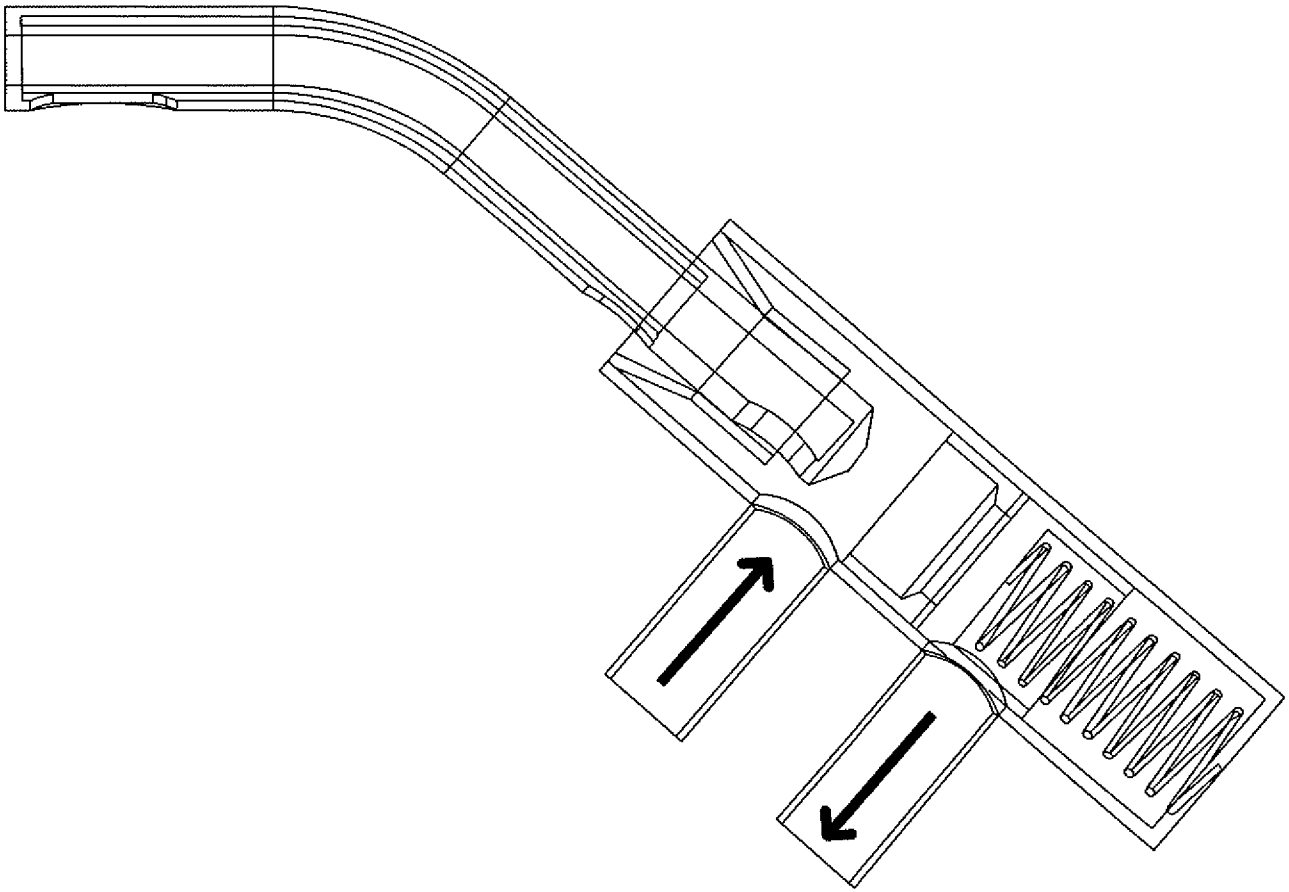
FIG. 2 illustrates a nozzle partially inserted coming in contact with rubber outer seal of a single-spout, dual-channel recyclable-fuel fueling nozzle.
Figure 3:
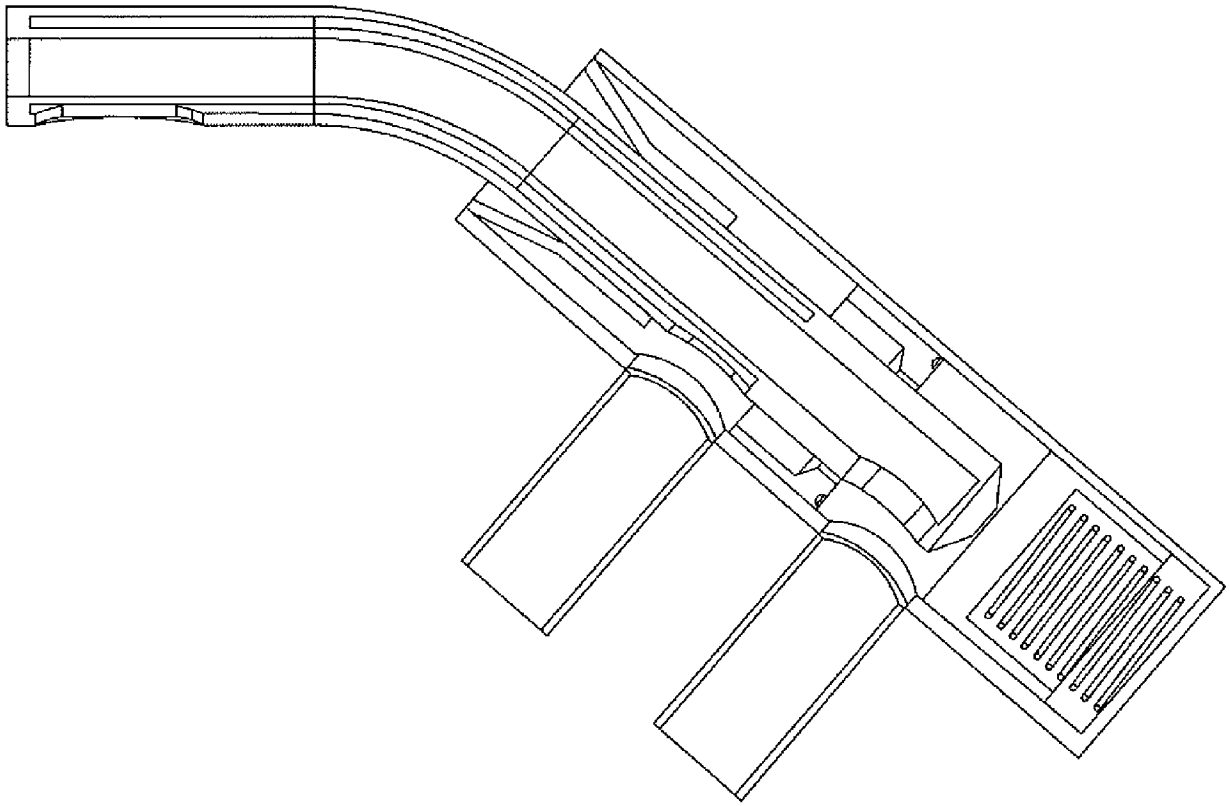
FIG. 3 illustrates a nozzle fully inserted opening a sliding gate valve of a recyclable-fuel filler neck.

As the nozzle is being inserted into the neck an outer rubber seal comes in contact with the outer diameter of the spout portion of the nozzle. FIG. 2 illustrates a nozzle partially inserted coming in contact with rubber outer seal of a single-spout, dual-channel recyclable-fuel fueling nozzle. As the spout is further inserted into the filler neck the far end of the spout pushes against a spring loaded sliding gate valve opening the fresh fuel chamber. FIG. 3 illustrates a nozzle fully inserted opening a sliding gate valve of a recyclable-fuel filler neck. This far end of the nozzle enters the fresh fuel chamber. The length of the spout is longer than a conventional spout so if a conventional spout is inserted it will never contact the gate valve to open it. At this point the fresh fuel chamber and the spent fuel chambers are now aligned with the openings of the nozzle and fueling can continue.

Fluid Flow

Figure 6:
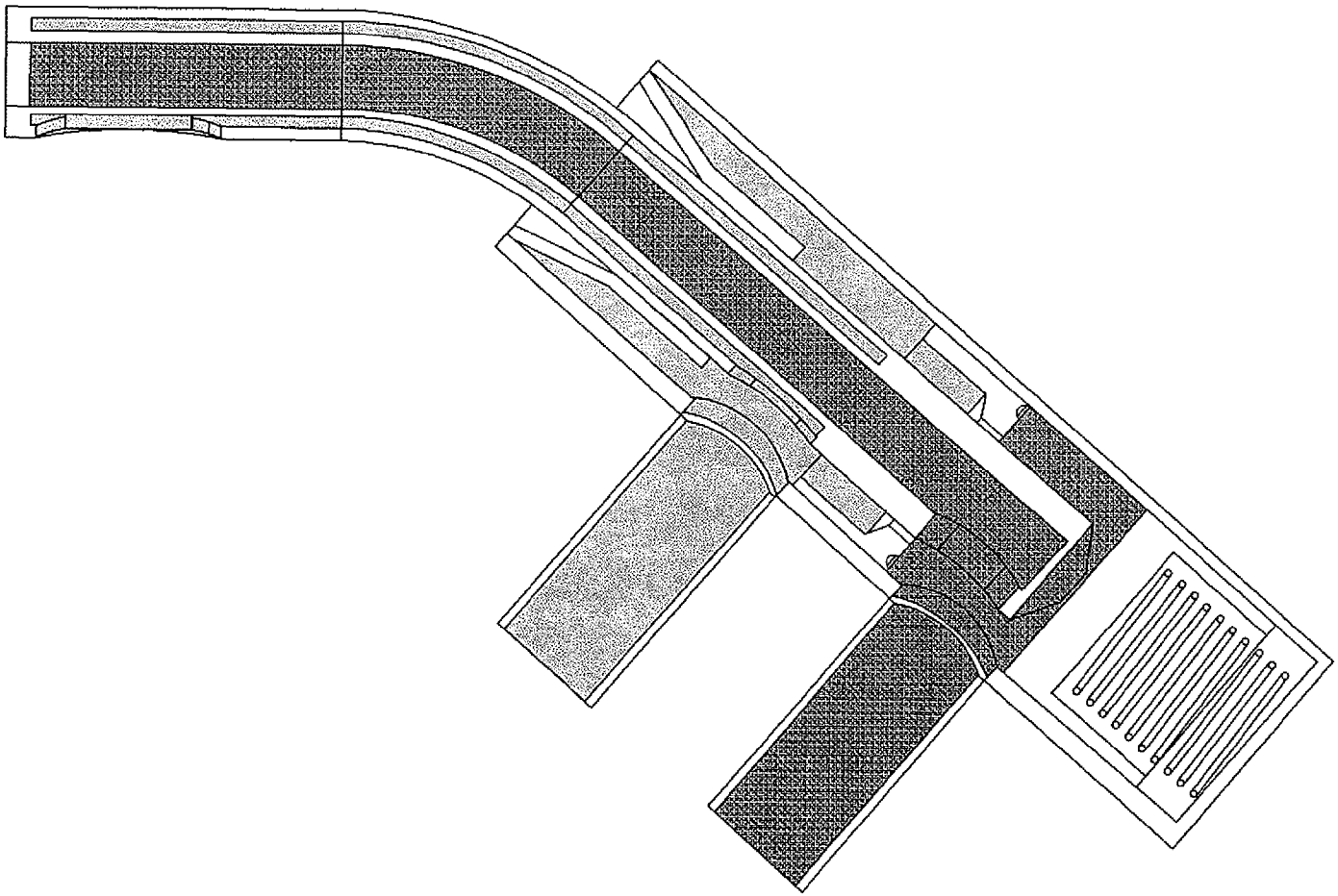
FIG. 6 shows fresh-fuel and spent-fuel flow paths within a mated nozzle and filler neck.

Communications with a host are now established. If the funding account is approved fueling can begin. Fuel flows out of the center channel of the nozzle into the fresh fuel chamber of the filler neck. FIG. 6 shows fresh-fuel and spent-fuel flow paths within a mated nozzle and filler neck. From the filler neck, fresh fuel flows into the fresh fuel tank within the vehicle. Spent fuel is pumped from the spent or used fuel tank into the spent fuel chamber in the neck and into the outer channel of the nozzle. The fresh fuel tank and spent fuel tank are contained within a single rigid volume. These can be two bladders within the outer tank case. Fuel is pumped into a fresh-fuel bladder though an opening and fills the fresh-fuel bladder. As the fresh-fuel bladder fills, the fresh-fuel bladder applies pressure to the spent-fuel bladder, forcing spent fuel out through an opening and into the filler neck.

RFID

The flow rate, fuel quantity, and identification of the vehicle are captured using an RFID tag (Radio Frequency Identification). The signals sent between the nozzle and the pump are encrypted so that any eavesdropping electronics are unable to utilize the data for illegal purposes. The RFID system can also be used as a credit card. The car pulls up to the pump. The driver inserts the nozzle into the filler neck. At that point the RFID tag and pump establish a secure communication link. Communications between the pump and a central card processor server are then established.

To secure the RF communications link to the central server, when a credit card account is first set up, a seed number is established based on the time for that account. The seed number infrequently changes, but a security number produced from the seed number by an algorithm does frequently change. A new security number is generated once every minute, in one example. This security number is generated by both the credit card server and the RFID tag. Since the security number is based on both a time and the seed number, the probability of randomly generating that the security number is quite low. When a transaction is about to begin, the security number is sent from the RFID tag to the central credit card processor to identify the RFID tag and compare the security number obtained from the RFID tag with a corresponding security number associated with an account. If the two security numbers are identical, then the transaction can be approved. This technique prevents a nearby electronic RF recording device from using the data presented from the RFID since the security number will have changed within the next minute. Electronics within the nozzle are intrinsically safe and meet local, state, and federal codes.

Prevention of Wrong Fuel

Figure 4:
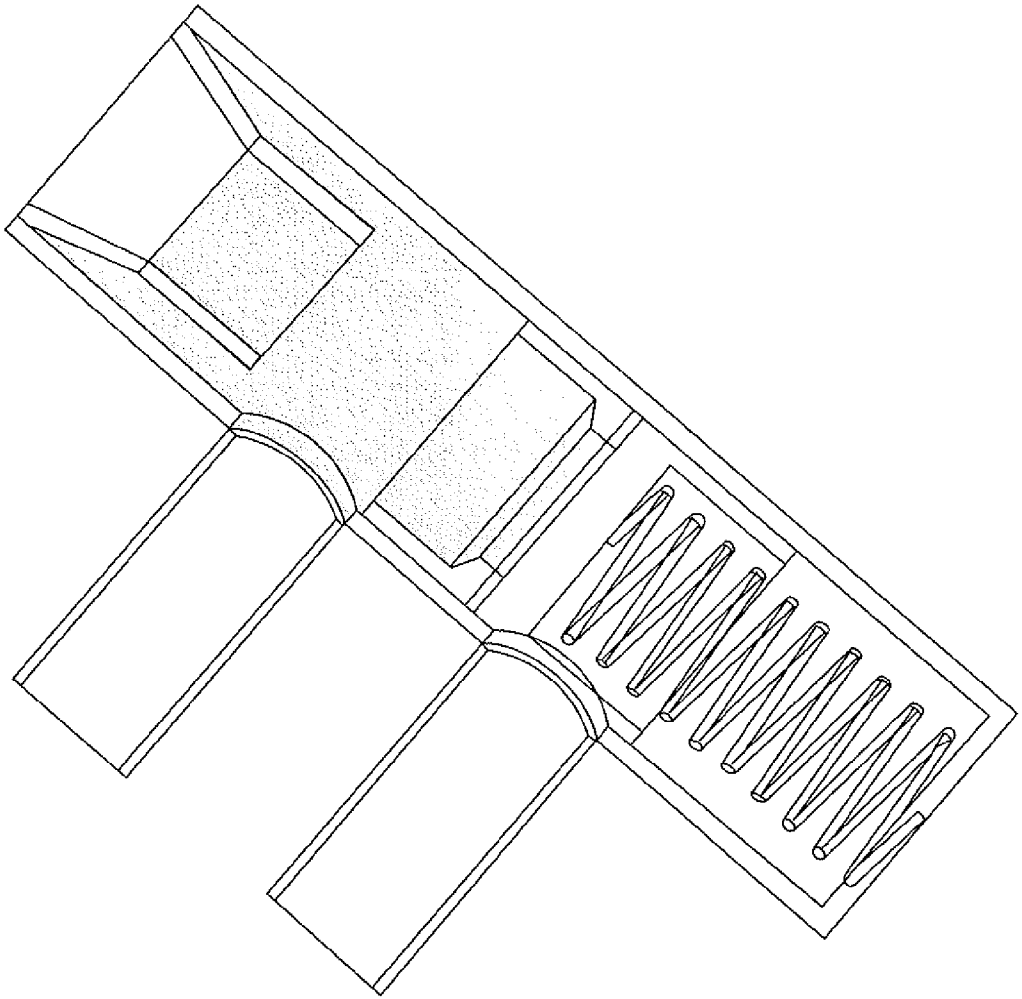
FIG. 4 illustrates a gate valve closed showing spent fuel chamber with wrong fuel of a recyclable-fuel filler neck.
Figure 5:
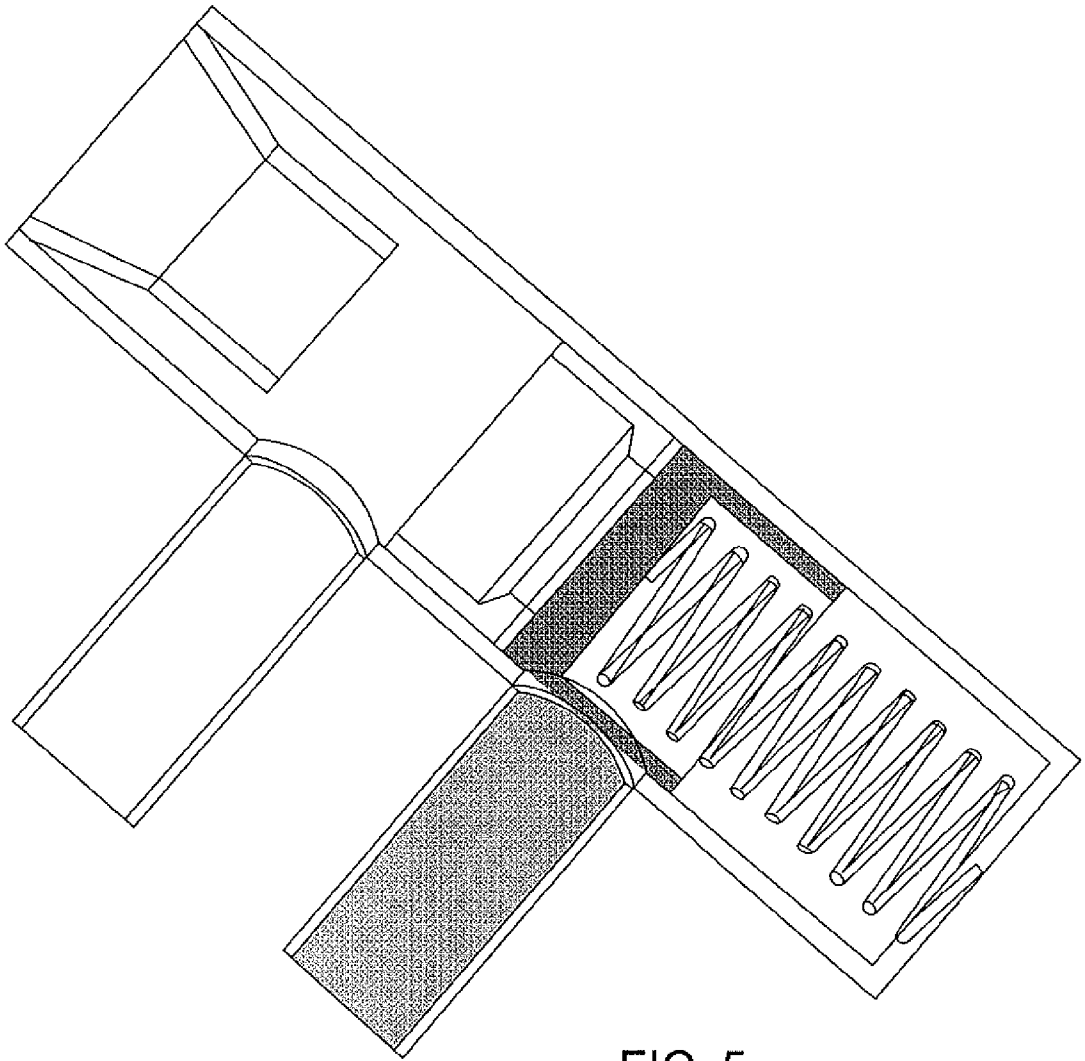
FIG. 5 shows a gate valve closed showing fresh fuel volume and path of a recyclable-fuel filler neck.

The filler neck is designed so that the lower chamber is for the input of fresh fuel while the upper chamber is for spent fuel. FIG. 4 illustrates a gate valve closed showing spent fuel chamber with wrong fuel of a recyclable-fuel filler neck. If the filling nozzle from a standard gasoline or diesel is inserted into the filler body, the upper chamber of the neck will fill up. This action of filling activates the automatic shut off of the gasoline or diesel nozzle by covering the venturi shutoff port typically located at the far end of the nozzle. This prevents an incorrect fuel from entering the fresh fuel chamber of the filler body. The automatic shut off feature using a venturi shutoff port is found on all nozzles currently being used. When a correct recyclable-fuel nozzle is inserted into the body of the filler neck while there is fluid in the upper chamber and actuated, the recyclable-fuel nozzle removes any fluid captured in the that chamber before pumping fresh fuel into the vehicle. When the correct recyclable-fuel is inserted into the filler neck, the upper chamber is first pumped out back to a temporary holding tank. The temporary holding tank can be analyzed for contaminants and other materials before contents of the temporary holding tank are sent to a final holding tank. In this way, if gasoline or diesel has inadvertently entered the system, it can be sent to a disposal tank rather than a recycle tank.

Look and Feel of the Nozzle

The single-spout, dual-channel recyclable-fuel fueling nozzle looks like today's existing nozzles with which most individuals have had the experience of filling a vehicle. The single-spout, dual-channel recyclable-fuel fueling nozzle has the same single spout with a single squeeze grip handle. Operation and look and feel of the single-spout, dual-channel recyclable-fuel fueling nozzle is similar to that of a standard nozzle one sees today at any refueling station. The outer diameter of the single-spout, dual-channel recyclable-fuel fueling nozzle is larger than a fueling nozzle that one finds today, to insure the nozzle is not accidentally inserted into a vehicle with a regular diesel or gasoline tank. In one example, the nozzle and filler neck are keyed so that if the nozzle is inserted into a non-keyed filler neck, the nozzle prevents flow from the nozzle into the fuel neck, thus preventing mixing fuel types.

Automatic Shutoff

The single-spout, dual-channel recyclable-fuel fueling nozzle has the same single-squeeze grip handle with automatic shut off. Certain examples of the single-spout, dual-channel recyclable-fuel fueling nozzle do not have the standard automatic shutoff venturi seen in gasoline and diesel fuel nozzles. The automatic shutoff system will be sensed by the removal of fuel in the spent fuel tank. Once the fuel has been removed, there is no more room in the tank for fresh fuel, so pumping of fresh fuel shuts off.

Environmental Seal

The single-spout, dual-channel recyclable-fuel fueling nozzle also has the capability to seal itself to the filler neck of the vehicle so as to not let vapor and or fuel escape into the environment. This can be accomplished using a rubber boot around the spout of the nozzle within the filler neck. The nozzle will be of such diameter so that it can not be mistakenly inserted into an existing filler neck of a vehicle using gasoline or diesel.

Although the present invention has been described in terms of particular embodiments, it is not intended that the invention be limited to these embodiments. Modifications will be apparent to those skilled in the art. For example, a variety of different materials can be used for the various reactor components discussed above.

The foregoing description, for purposes of explanation, used specific nomenclature to provide a thorough understanding of the invention. However, it will be apparent to one skilled in the art that the specific details are not required in order to practice the invention. The foregoing descriptions of specific embodiments of the present invention are presented for purpose of illustration and description. They are not intended to be exhaustive or to limit the invention to the precise forms disclosed. Many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents:

The invention claimed is:

1. A single-spout, dual-channel recyclable-fuel fueling nozzle comprising:

a single-spout nozzle that includes a spent-fuel outer channel and a fresh-fuel inner channel;

a spent-fuel opening that interconnects the spent-fuel channel with a vehicle channel to a spent-fuel tank;

a fresh-fuel opening that interconnects the fresh-fuel channel with a vehicle channel to a fresh-fuel tank; and a closed nozzle end that is adapted to push down on a sliding-gate valve within a vehicle filler neck.

2. The single-spout, dual-channel recyclable-fuel fueling nozzle of claim 1 wherein the fresh-fuel inner channel within the single-spout nozzle extends further toward the closed nozzle end than the spent-fuel outer channel.

3. The single-spout, dual-channel recyclable-fuel fueling nozzle of claim 2 wherein the fresh-fuel opening opens in a direction orthogonal to a long dimension of a final straight portion of the single-spout, dual-channel recyclable-fuel fueling nozzle; and wherein the fresh-fuel opening is positioned closer to the closed nozzle end than is positioned the spent-fuel opening.

4. The single-spout, dual-channel recyclable-fuel fueling nozzle of claim 3 wherein fresh fuel flows in the direction orthogonal to the long dimension of the final straight portion of the single-spout, dual-channel recyclable-fuel fueling nozzle through the fresh-fuel opening into the vehicle channel to the fresh-fuel tank when the single-spout, dual-channel recyclable-fuel fueling nozzle has been pushed into the vehicle filler neck to open the sliding-gate valve and when the single-spout, dual-channel recyclable-fuel fueling nozzle is activated to pump fresh fuel into the vehicle.

5. The single-spout, dual-channel recyclable-fuel fueling nozzle of claim 2 wherein the spent-fuel opening opens in a direction orthogonal to a long dimension of a final straight portion of the single-spout, dual-channel recyclable-fuel fueling nozzle; and wherein the spent-fuel opening is positioned further from the closed nozzle end than is positioned the fresh-fuel opening.

6. The single-spout, dual-channel recyclable-fuel fueling nozzle of claim 5 wherein spent fuel flows in the direction orthogonal to the long dimension of the final straight portion of the single-spout, dual-channel recyclable-fuel fueling nozzle through the spent-fuel opening into the spent-fuel outer channel when the single-spout, dual-channel recyclable-fuel fueling nozzle has been pushed into the vehicle filler neck to open the sliding-gate valve and when the single-spout, dual-channel recyclable-fuel fueling nozzle is activated to pump fresh fuel into the vehicle.

7. The single-spout, dual-channel recyclable-fuel fueling nozzle of claim 1 wherein fluid flow is synchronized within the single-spout, dual-channel recyclable-fuel fueling nozzle such that, if a difference between a quantity of spent fuel flowing into the single-spout, dual-channel recyclable-fuel fueling nozzle from the vehicle channel to the spent-fuel tank and a quantity of fresh fuel flowing out of the single-spout, dual-channel recyclable-fuel fueling nozzle into the vehicle channel to the fresh-fuel tank is not below a small threshold value, fuel flow is halted.

8. The single-spout, dual-channel recyclable-fuel fueling nozzle of claim 1 wherein the single-spout, dual-channel recyclable-fuel fueling nozzle has an appearance and external configuration similar to traditional fueling nozzles used in gas stations for fueling vehicles.

9. The single-spout, dual-channel recyclable-fuel fueling nozzle of claim 1 wherein the single-spout, dual-channel recyclable-fuel fueling nozzle has a final straight portion connected to an initial straight portion by a curved portion.

10. The single-spout, dual-channel recyclable-fuel fueling nozzle of claim 9 wherein final straight portion and the initial straight portion of the single-spout, dual-channel recyclable-fuel fueling nozzle are approximately cylindrical, with circular cross sections.

11. A vehicle fueling system comprising:

a single-spout nozzle that includes a spent-fuel outer channel, a fresh-fuel inner channel, a first spent-fuel opening that interconnects the spent-fuel channel with a vehicle channel to a spent-fuel tank, a first fresh-fuel opening that interconnects the fresh-fuel channel with a vehicle channel to a fresh-fuel tank, and a closed nozzle end; and a vehicle filler neck that includes a second spent-fuel opening to the vehicle channel to the spent-fuel tank, a second fresh-fuel opening to the vehicle channel to the fresh-fuel tank, and a spring-loaded sliding-gate valve that, when the closed nozzle end is pushed into the vehicle filler neck, is pushed downward against a spring force to expose the second fresh-fuel opening.

12. The vehicle fueling system of claim 11 wherein the fresh-fuel inner channel within the single-spout nozzle extends further toward the closed nozzle end than the spent-fuel outer channel.

13. The vehicle fueling system of claim 12 wherein the first fresh-fuel opening opens in a direction orthogonal to a long dimension of a final straight portion of the single-spout, dual-channel recyclable-fuel fueling nozzle; and wherein the first fresh-fuel opening is positioned closer to the closed nozzle end than is positioned the spent-fuel opening.

14. The vehicle fueling system of claim 13 wherein fresh fuel flows in the direction orthogonal to the long dimension of the final straight portion of the single-spout, dual-channel recyclable-fuel fueling nozzle through the first fresh-fuel opening into the second fresh-fuel opening when the single-spout nozzle has been pushed into the vehicle filler neck to open the sliding-gate valve and when the single-spout, dual-channel recyclable-fuel fueling nozzle is activated to pump fresh fuel into the vehicle.

15. The vehicle fueling system of claim 12 wherein the first spent-fuel opening opens in a direction orthogonal to a long dimension of a final straight portion of the single-spout nozzle; and wherein the first spent-fuel opening is positioned further from the closed nozzle end than is positioned the first fresh-fuel opening.

16. The vehicle fueling system of claim 15 wherein spent fuel flows in the direction orthogonal to the long dimension of the final straight portion of the single-spout nozzle through the first spent-fuel opening from the second spent-fuel opening when the single-spout nozzle has been pushed into the vehicle filler neck to open the sliding-gate valve and when the single-spout nozzle is activated to pump fresh fuel into the vehicle.

17. The vehicle fueling system of claim 11 wherein fluid flow is synchronized within the single-spout nozzle such that, if a difference between a quantity of spent fuel flowing into the single-spout nozzle from the second spent-fuel opening and a quantity of fresh fuel flowing out of the first fresh-fuel opening into the second fresh-fuel opening is not below a small threshold value, fuel flow is halted.

* * * * *